US010899026B2

(12) United States Patent
Herlitz

(10) Patent No.: US 10,899,026 B2
(45) Date of Patent: Jan. 26, 2021

(54) UTILITY KNIFE

(71) Applicant: MARTOR KG, Solingen (DE)

(72) Inventor: Martin Herlitz, Remscheid (DE)

(73) Assignee: Martor KG, Solingen (DE)

( * ) Notice: Subject to any disclaimer, the term of this patent is extended or adjusted under 35 U.S.C. 154(b) by 0 days.

(21) Appl. No.: 16/041,899

(22) Filed: Jul. 23, 2018

(65) Prior Publication Data

US 2019/0111577 A1 Apr. 18, 2019

(30) Foreign Application Priority Data

Oct. 16, 2017 (DE) ..... 10 2017 009 630

(51) Int. Cl.
*B26B 5/00* (2006.01)

(52) U.S. Cl.
CPC ..... *B26B 5/003* (2013.01)

(58) Field of Classification Search
CPC ..... B26B 5/00; B26B 5/001; B26B 5/003
See application file for complete search history.

(56) References Cited

U.S. PATENT DOCUMENTS

| | | | | |
|---|---|---|---|---|
| 4,899,443 | A | 2/1990 | Beermann | |
| 7,784,189 | B2 | 8/2010 | Polei | |
| 7,784,199 | B2 | 8/2010 | Polei | |
| 8,468,702 | B2 * | 6/2013 | Doeren | B26B 5/003 30/162 |
| 9,770,833 | B2 * | 9/2017 | Schekalla | B26B 5/001 |

FOREIGN PATENT DOCUMENTS

| | | | | |
|---|---|---|---|---|
| DE | 102005049411 | B3 * | 3/2007 | B26B 5/001 |
| DE | 202009009397 | U1 | 12/2010 | |
| WO | WO-2011157262 | A2 * | 12/2011 | B26B 5/003 |

* cited by examiner

*Primary Examiner* — Jennifer B Swinney
(74) *Attorney, Agent, or Firm* — Andrew Wilford

(57) ABSTRACT

A knife having a housing (11) and a blade support (18) for holding a blade (19), the blade support being movable between a retracted position in which the blade support (18) is moved by a reset device (22) against a stop of the housing (11), and a fully advanced position, the blade support having a base (23) and a blade cover (24) movable between a closed position and an open position relative to the base (23), and in the closed position, the base (23) and the blade cover (24) firmly secure the blade (19) in a blade seat (41) between the base (23) and the blade cover (24) and in the open position, the base (23) and the blade cover (24) are so oriented relative to each other that a blade can be changed.

11 Claims, 9 Drawing Sheets

UTILITY KNIFE

Figure 1:
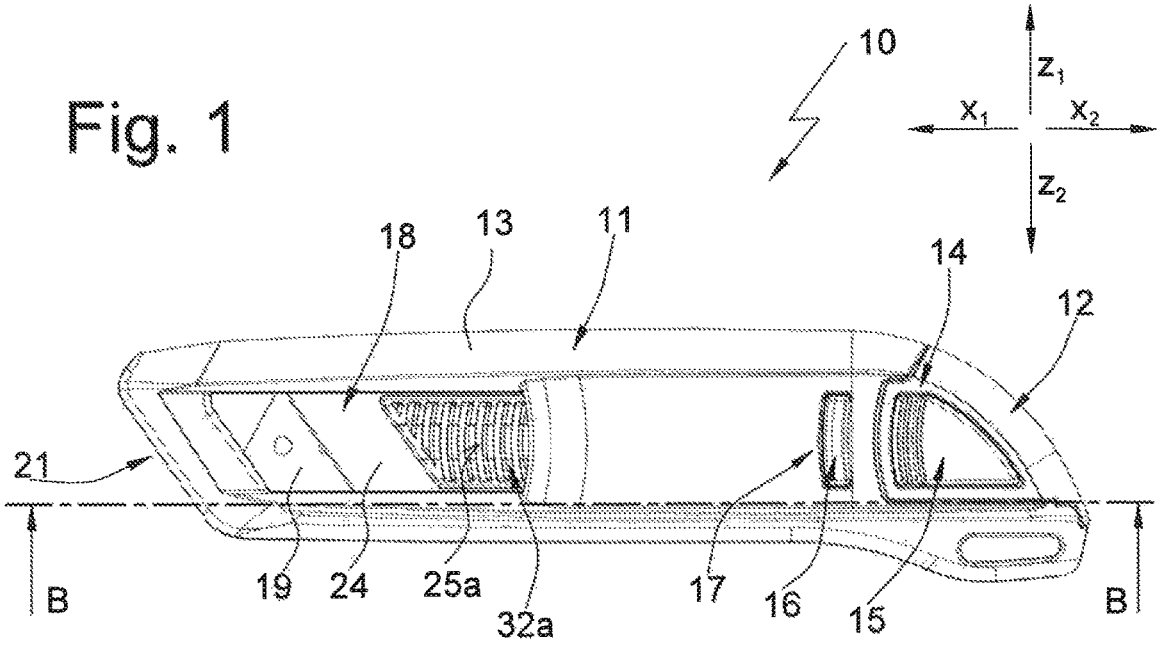

Knives in which the blade is held between a base of a blade support and a blade cover are known in the art. In a closed position of the blade cover, the blade is held firmly in the blade support and in an open position the blade can be removed from the blade support. In normal operation, housing surfaces prevent the blade cover from being accidentally moved into the open position. The blade cover can be moved into the open position by opening the housing.

Such a knife is known from DE 37 36 968 [U.S. Pat. No. 4,899,443].

It is an object of the invention to provide a knife in which the blade change can be performed easier and safer.

The object is achieved by a knife having the features of claim 1.

The knife comprises a housing and a blade support for holding a blade. The blade support is movable between a retracted position in which the blade support is moved by a reset device up to a stop of the housing, and at least the cutting edge of the blade is inaccessible to the user within the housing and a fully advanced position. The fully advanced position may be, for example, a cutting position.

The blade support comprises a base and a blade cover movable between a closed position and an open position relative to the base. In the closed position, the base and the blade cover are relatively positioned such that the blade is firmly held in a blade seat between the base and the blade cover. In the open position, the base and the blade cover are positioned relative to each other such that a blade change can be performed. The base is displaceable, for example, between the retracted position and the advanced position. The base and/or the blade cover has, for example, a formation that works together with a formation of the blade to hold the blade in the intended position in the blade seat of the blade support.

A guide assembly of the knife has a first guide formation on the blade cover and a second guide formation on the housing. The second guide formation form a primary guide surface and a secondary guide surface that work together with at least one counter surface of the first guide formation. The blade cover is held in the closed position when the counter surface works together with the primary guide surface. The blade cover is held in the open position when the counter surface works together with the secondary guide surface.

For example, the knife may include a plurality of pairs of first and a second guide formation working together. The first guide formation are provided, for example, on two opposite sides of the blade cover and the second guide formation, for example, at correspondingly spaced positions of the base.

In particular, the first guide formation have a first counter surface and a second counter surface. The first counter surface works together with the first guide surface and the second counter surface works together with the second guide surface.

An advantage of the invention is that the blade cover remains in the respectively set position, i.e., open position or closed position, and does not unintentionally move out of this position. This results in much easier handling when changing the blade. In addition, the blade change can be performed safer, because the parts of the knife are kept in defined positions. For example, the user does not have to hold the blade cover in the open position.

For example, the first guide formation and the second guide formation work together in the retracted position of the blade support. That is, the first guide formation and the second guide formation work together when the blade support has been displaced by the reset device to the retracted position. Alternatively, however, the first guide formation and the second guide formation may also work together in a position between the retracted and the advanced positions.

For example, the blade cover is pivotable relative to the base between the closed position and the open position. With the pivotal mounting, it is possible, for example, to hold the blade cover in the respective position by initiating a force in the arm of a one-armed lever or in one of the arms of a two-armed lever that forms the blade cover.

The second guide formation are, for example, on the base. They may be configured, for example, on the housing of the base.

The first guide surface and the second guide surface are separated from each other, for example, by at least one wall. For example, the first guide surface and the second guide surface meet at a ridge.

For example, the primary guide surface and the secondary guide surface form a guide track, and the first guide formation is movable on the guide track between engagement with the primary guide surface and the secondary guide surface. The guide track corresponds to a control cam, with which the blade cover is moved into the open position or in the closed position and held in this position.

For example, the blade support must be moved out of the retracted position in order to move the first guide formation between engagement with the primary guide surface and engagement with the secondary guide surface. For example, the blade support has to be moved somewhat in the direction of the advanced position on its movement path in order to change between the contact of the first guide surface with the first counter surface and the second guide surface with the second counter surface. For example, the first guide formation and the second guide formation have to get over a ridge.

The surfaces working together, i.e., for example, the first guide surface and the first counter surface and/or the second guide surface and the second counter surface, for example, are configured obliquely to the actuating direction and form a motion converter. With a force on the blade cover in a first direction, the blade support is then automatically moved in a second direction in order to be able to perform the change between the contact of first guide surface and first counter surface and second guide surface and second counter surface.

The housing of the knife includes, for example, a base and a cover. For example, the blade support is movably guided at the base between the retracted position and the advanced position. For example, in the retracted position, the blade support has only one degree of freedom in the direction of the advanced position.

The cover forms, for example, a front housing part in the direction of a longitudinal axis of the knife, and the base forms a rear housing part.

The fully advanced position of the blade support is, for example, a cutting position in which the blade projects from an opening of the housing.

At least one housing part of the housing is, for example, detachable such that the housing can be opened and a blade change can be performed. The detachable housing part forms, for example, a sleeve that encloses the blade support on all sides or only a side wall of the housing in the form of a plate.

Figure 2:
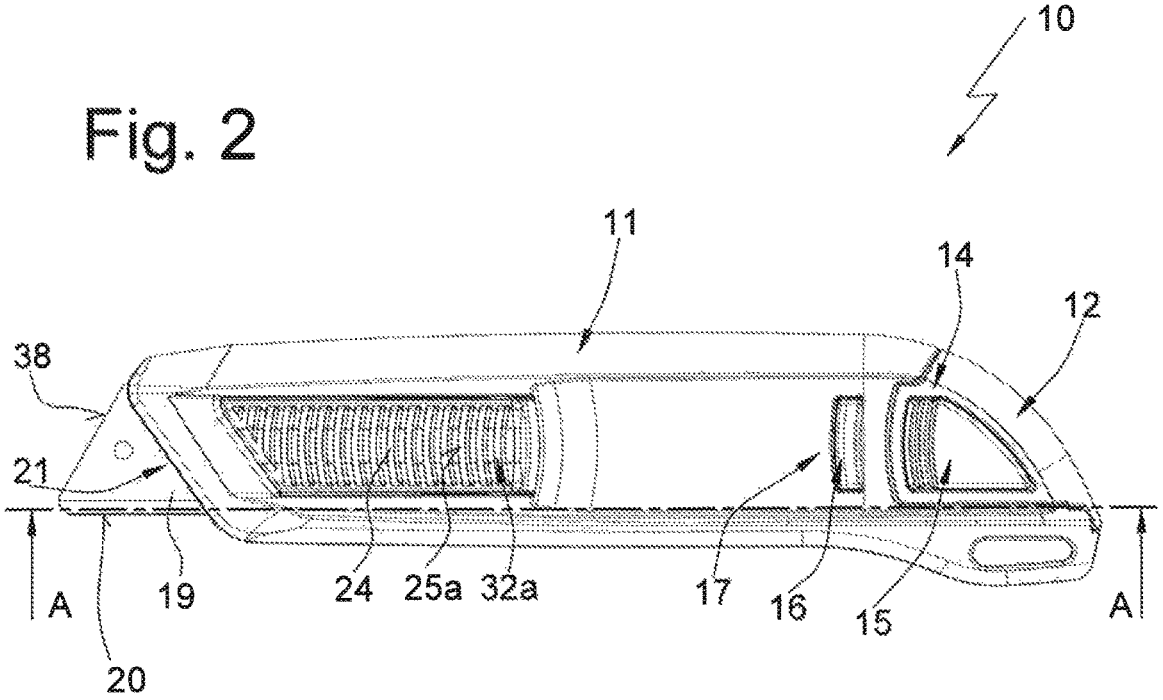
Figure 3:
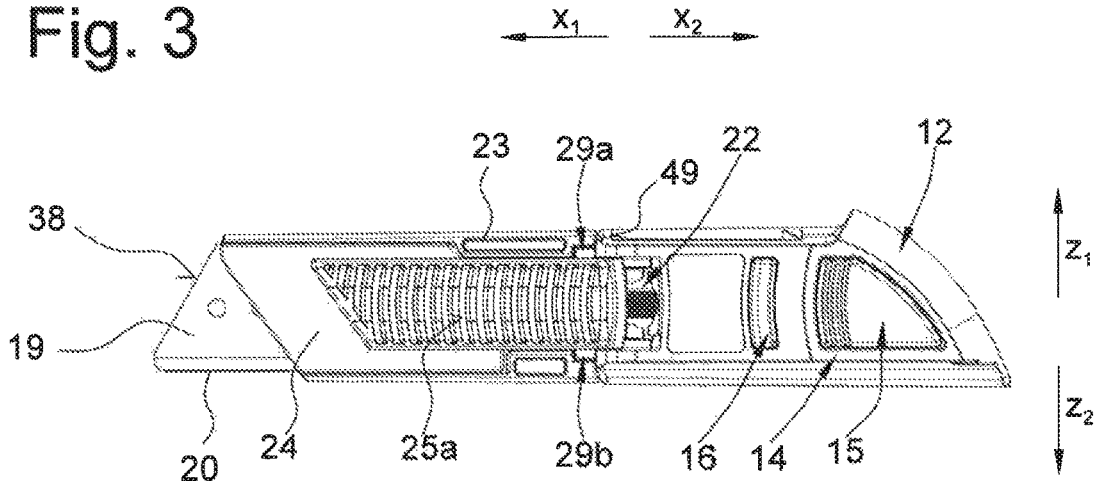
Figure 4:
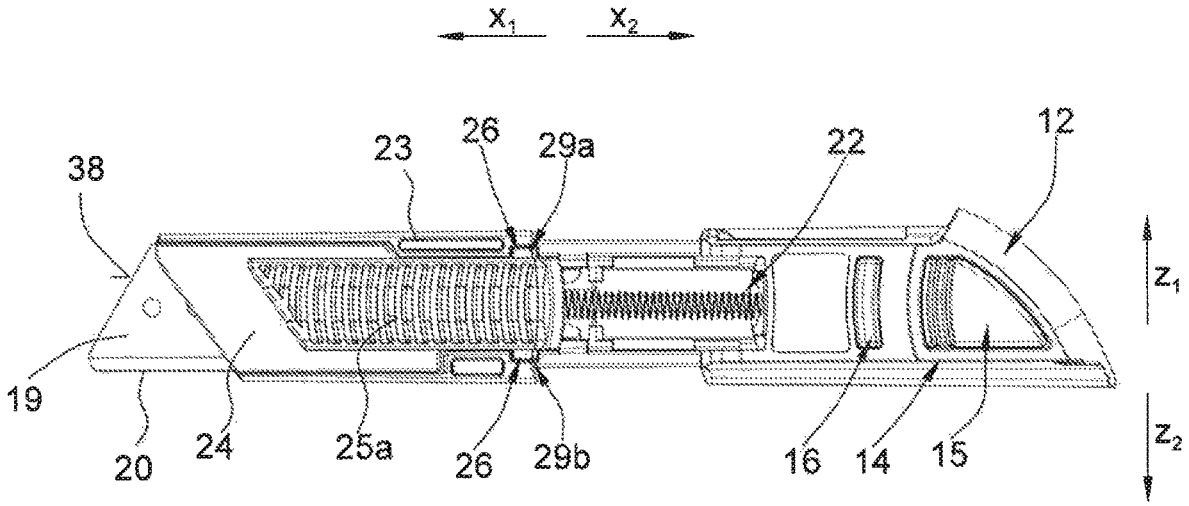
Figure 5:
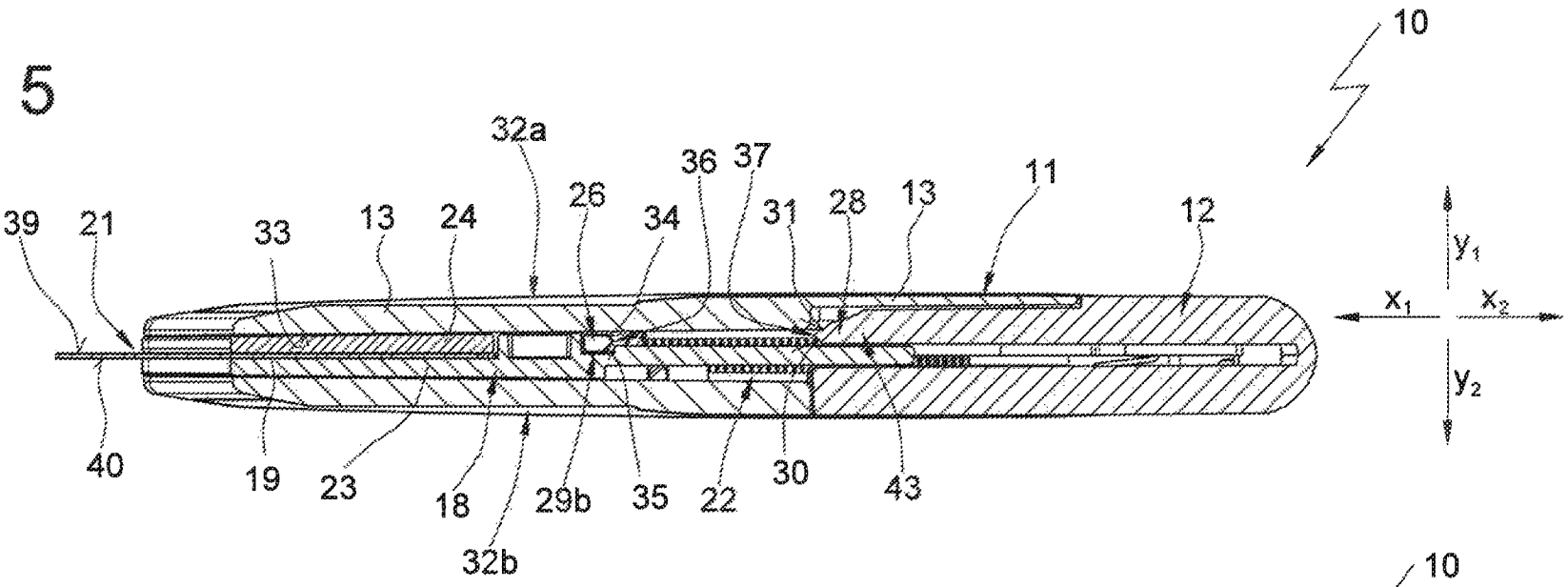
Figure 6:
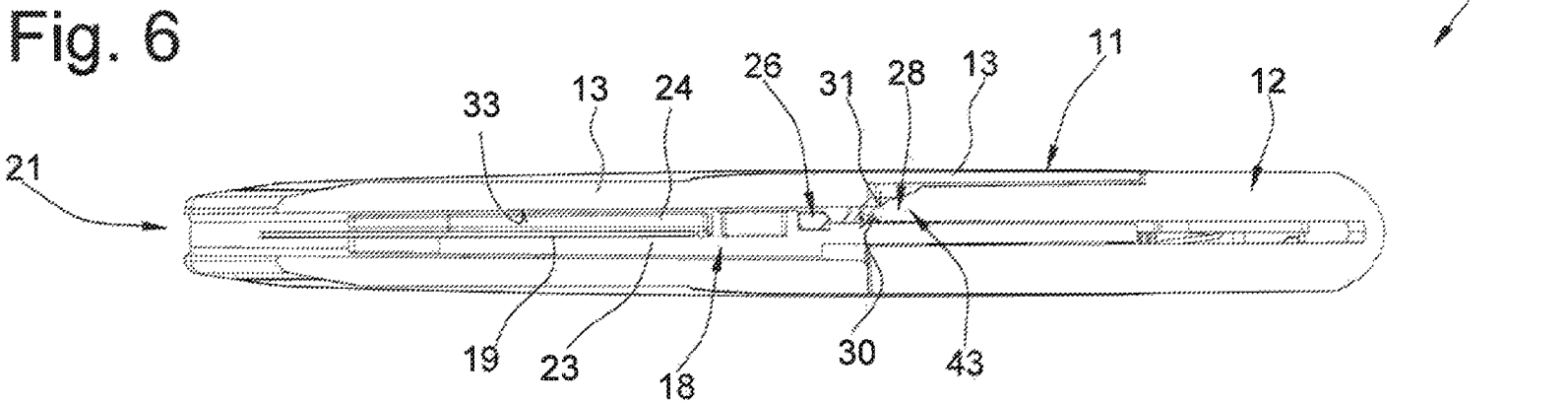
Figure 7:
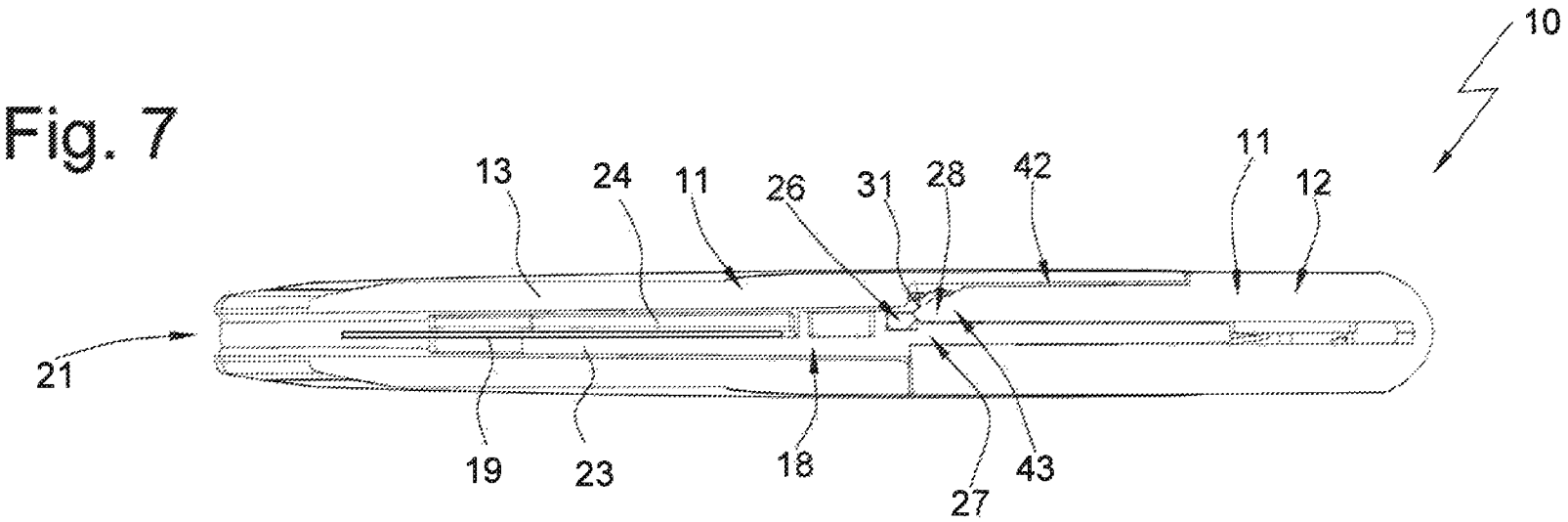
Figure 8:
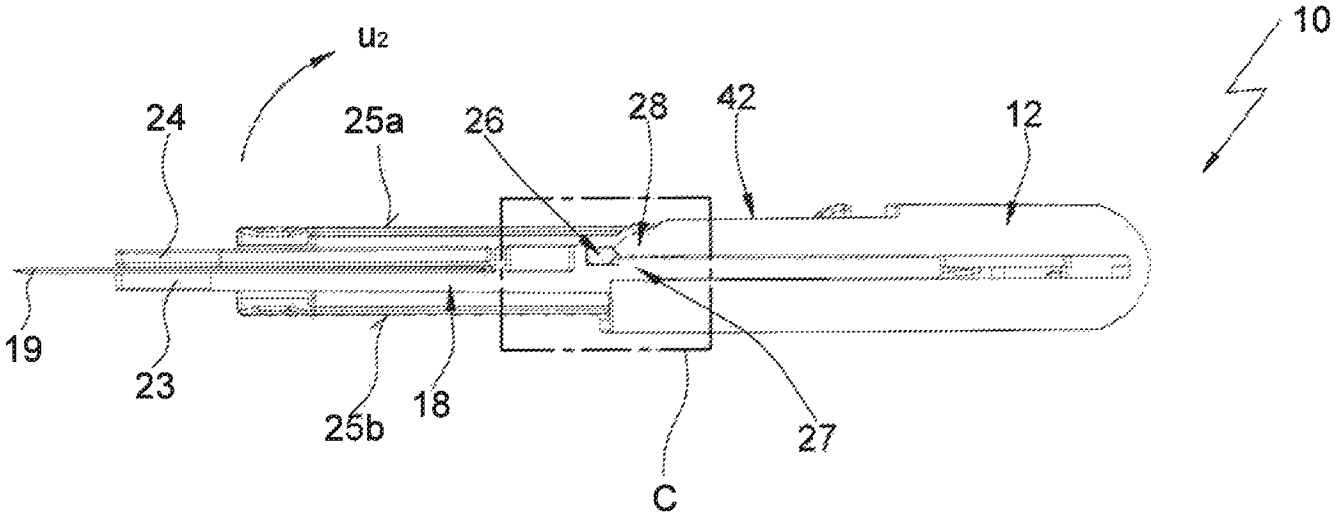
Figure 8A:
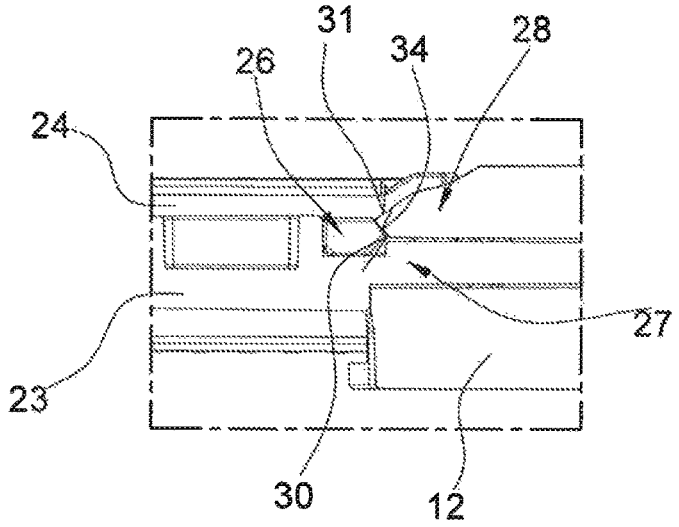
Figure 10A:
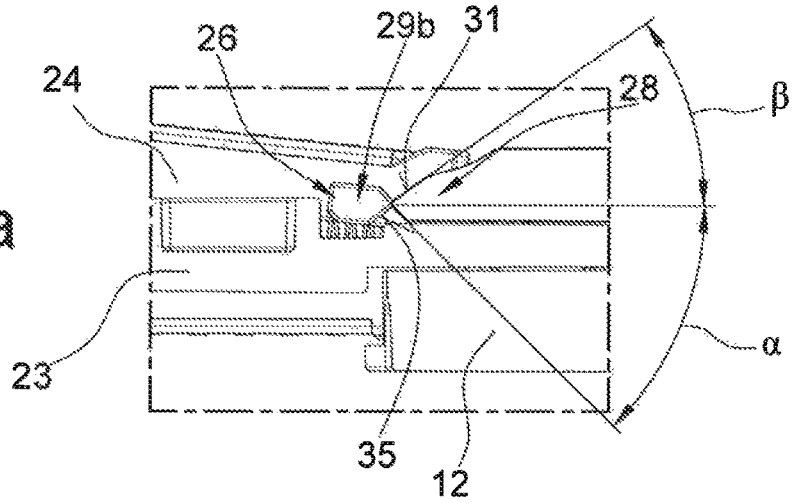
Figure 11A:
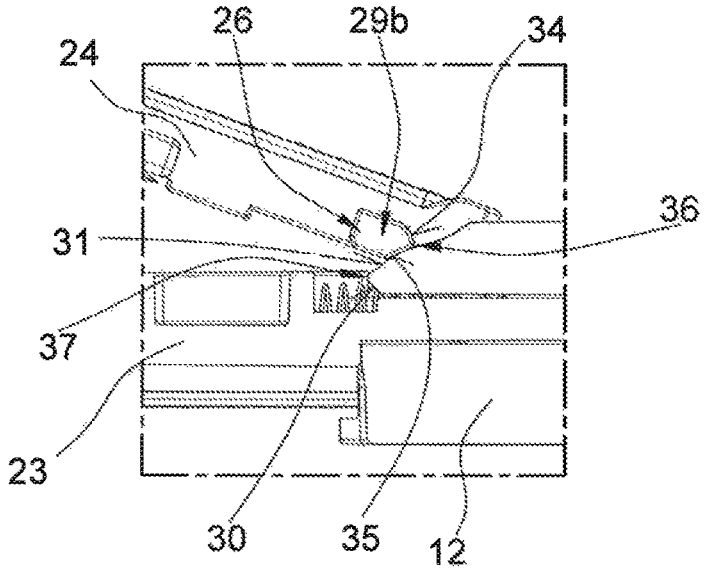
Figure 9:
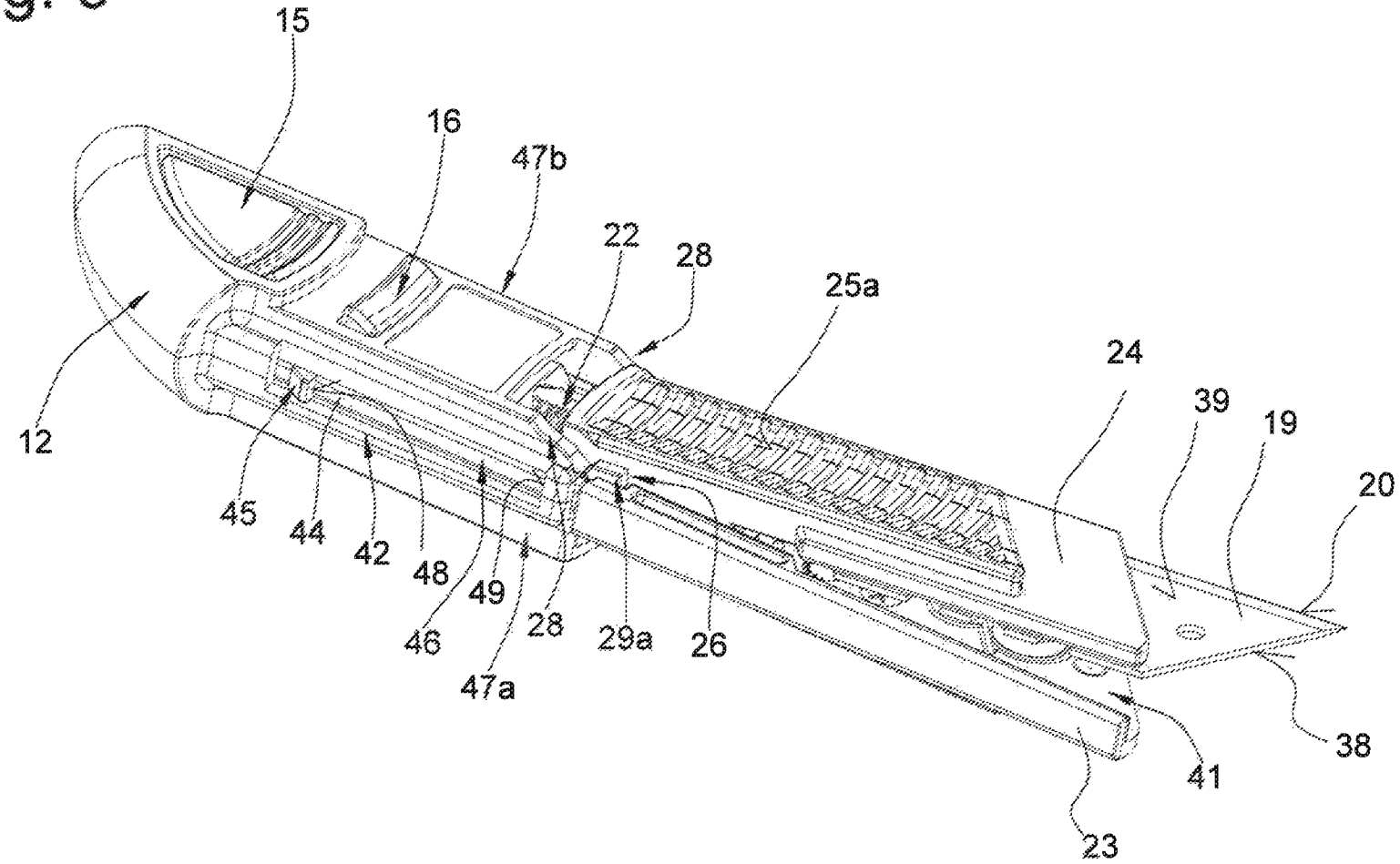
Figure 10:
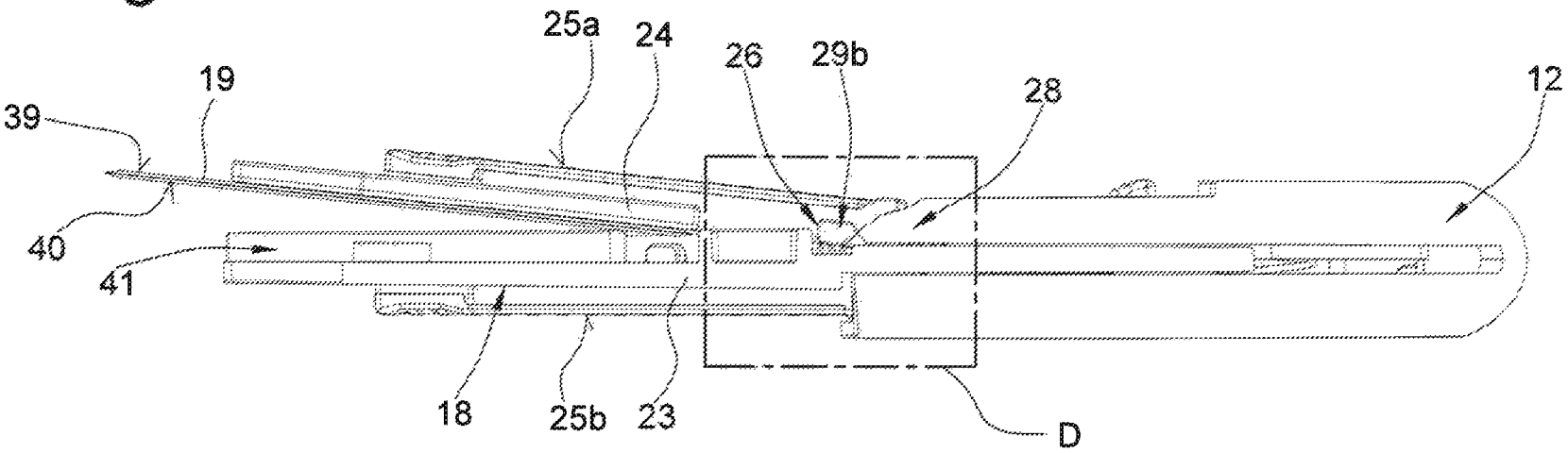
Figure 11:
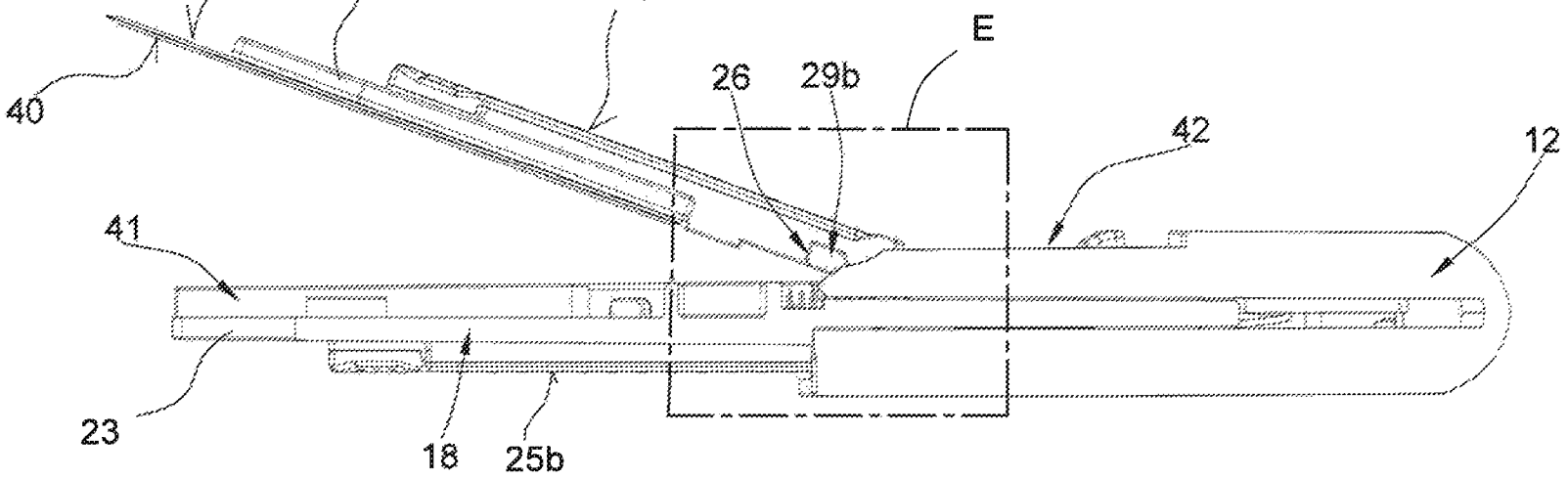
Figure 12:
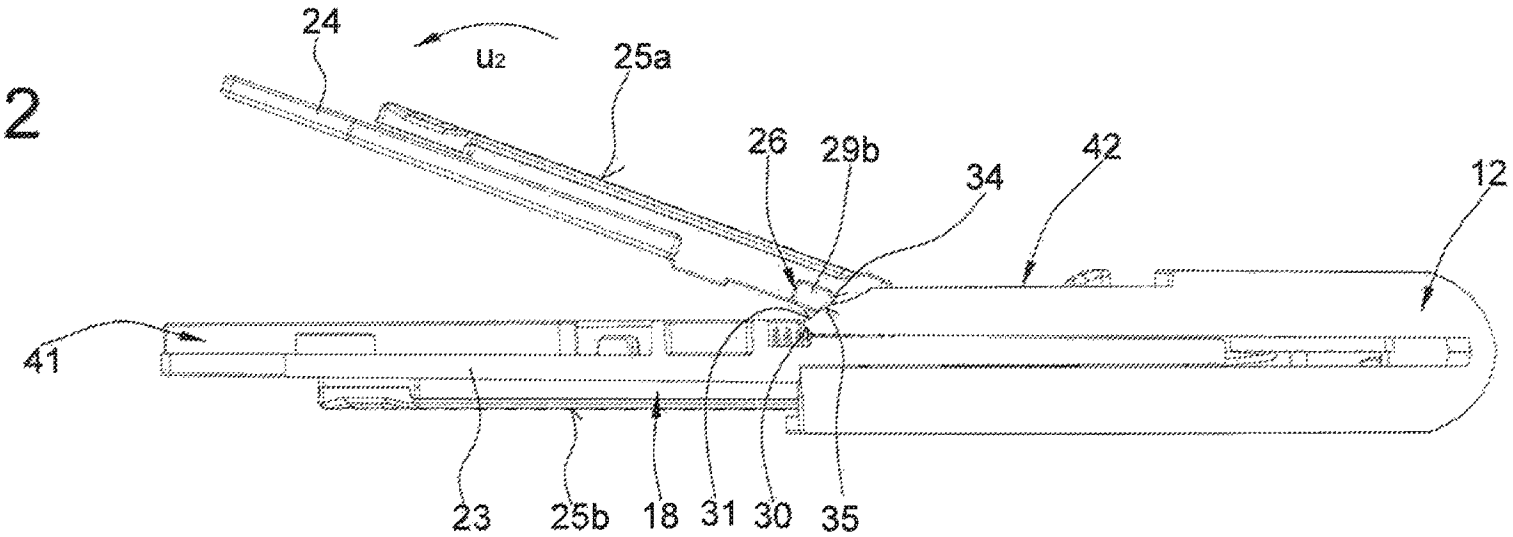
Figure 13:
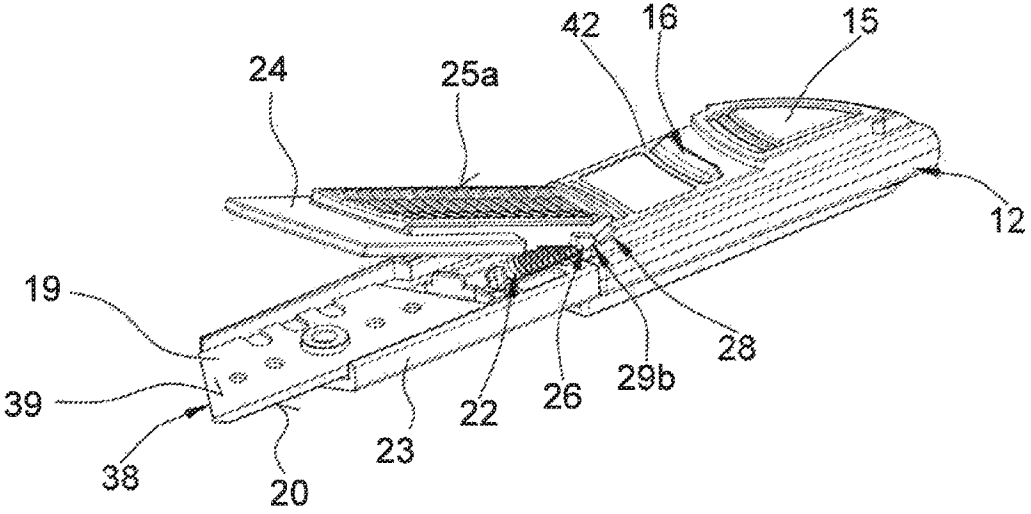
Figure 14:
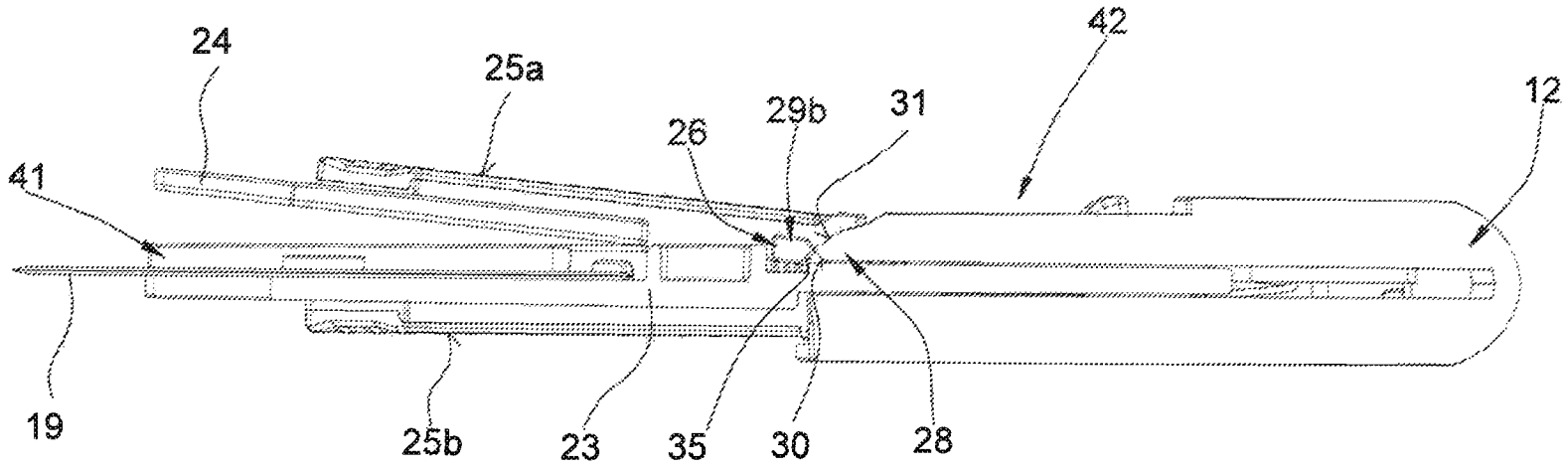

Further advantages will become apparent from the description of an embodiment shown schematically in the drawing. It shows in:

FIG. 1 a side view of the knife with the blade support in a fully retracted position, FIG. 2 a side view like FIG. 1 but with the blade support in a fully advanced position, FIG. 3 a side view of the knife like FIG. 1 but with a front housing part not shown, FIG. 4 a side view of the knife like FIG. 2 but with a front housing part is not shown, FIG. 5 a section along line A-A of FIG. 2 through the knife, FIG. 6 a section like FIG. 5 but with the blade support in an intermediate position between the fully advanced and retracted positions, hatching having been omitted for the sake of clarity, FIG. 7 a section through the knife along section line B-B in FIG. 1, hatching having been omitted for the sake of clarity, FIG. 8 a section like FIG. 7, but without a front housing part, FIG. 8*a* a large-scale view of the detail indicated at C in FIG. 8, FIG. 9 a perspective view of the knife without a front housing part and with a blade cover of the knife in an intermediate position between a closed position and an open position, FIG. 10 a sectional view of the knife based on FIG. 8 but with the blade cover in the position of FIG. 9, FIG. 10*a* large-scale view of the detail shown at D in FIG. 10, FIG. 11 a sectional view of the knife as in FIG. 8 but with the blade cover in the open position, FIG. 11*a* is a large-scale view of the detail indicated at E in FIG. 11, FIG. 12 a view of the knife as in FIG. 11 but with the blade removed, FIG. 13 a perspective view of the knife with the blade cover moved into the open position and with the blade in the blade seat, FIG. 14 a view of the knife as in FIG. 12 but with the blade in the blade support and the blade cover in an intermediate position as in FIG. 10.

The knife as a whole is designated by the reference numeral 10 in the figures. Like reference numerals in the various figures indicate corresponding features, even if lower-case letters are added or omitted.

FIG. 1 shows that the knife has a housing 11 that comprises a housing base 12 and a housing cover 13. The housing base 12 forms a rear housing part and the housing cover 13 forms a front housing part of the housing 11. The cover 13 can be releasably locked to the base 12 by a latch assembly 14. The latch assembly 14 comprises a button 15 and a latch element 16 carried on the base 12, and a recess 17 formed in the cover 13. Actuation of the button 15 results in the latch element 16 moving out of engagement with the recess 17 so that the cover 13 can be released from a housing seat 42 on the base 12 and removed from the base 12.

A blade support 18 for holding a blade 19 is movable between a retracted position shown in FIG. 1 and an advanced position shown in FIG. 2. In the retracted position, provided that the cover 13 is mounted on the base 12, the blade 19 is inside the housing 11 such that the user cannot be injured by a cutting edge 20 of the blade 19. The retracted position is thus a safety position. In the advanced position, the cutting edge 20 projects from an opening 21 of the housing 11, so that a cutting operation can be performed. In this embodiment, the opening 21 is formed in the cover 13. From the retracted position of FIGS. 1 and 3, the blade support 18 is movable in a direction $x_1$ into the advanced position of FIGS. 2 and 4. From the advanced position, the blade support 18 is movable in the direction $x_2$ into the retracted position.

The retracted position is shown in FIG. 3 and the advanced position is shown is FIG. 4, and in FIGS. 3 and 4, the cover 13 is not shown. The blade support 18 is loaded by a reset device 22 in the retracted position. The reset device 22 is formed of a spiral spring in the present embodiment, which is held with one end region on the base 12 and with another end region on the blade support 18.

The blade support 18 comprises a base 23 and a blade cover 24. The base 23 is mounted on the base 12 so that it can be displaced in the directions $x_1$ and $x_2$ between the retracted and advanced positions. The reset device 22 is attached to the base 23 so that it is loaded in the direction $x_2$. The blade cover 24 is pivotally mounted to the base 23 in directions $u_1$ and $u_2$ relative to the base 23.

In FIGS. 3 and 4, it can be seen that the blade cover 24 and the base 23 are each provided with a profiled actuating surface 25*a* and 25*b*, on which the blade support 18 can be contacted or touched by the user through recesses 32*a* and 32*b* of the cover 13 and can be displaced against the force of the reset device 22 between the retracted position and the advanced position.

For example, in FIG. 3, it can be seen that the blade cover 24 is provided with a first guide formation 26 of a guide device 27. The guide device 27 holds the blade cover 24 in the respectively set closed position or open position. The first guide formation 26 comprise a primary counter surface 34 and a secondary counter surface 35. The counter surfaces 34 and 35 converge on a ridge 36.

The first guide formation 26 work together with a second guide formation 28 of the guide device 27, which are configured on the base 12. The first guide formation 26 are formed in the present embodiment of projections 29*a* and 29*b* of the blade cover 24, which extend approximately at right angles to the movement direction $x_1$, $x_2$ of the blade support 18 in the directions $z_1$ or $z_2$. The projections 29 are formed integrally with the second holder 24.

The second guide formation 28 comprise (see FIG. 5) a primary guide surface 30 and a secondary guide surface 31 that are configured on a wall 43 of the base 12. In the present embodiment, the guide surfaces 30 and 31 are part of a guide track, which includes the guide surfaces 30 and 31 and a ridge 37 formed by the convergence of the guide surfaces 30 and 31.

In FIG. 5, it can be seen that the blade 19 is held between the base 23 and the blade cover 24 and that an inner surface 33 of the cover 13 prevents the blade cover 24 from being able to be moved from the closed position shown in FIGS. 5 to 7 into the open position. Furthermore, the different operating positions of the blade support 18 and the respective positions of the first guide formation 26 provided on the blade support 18 are shown in FIGS. 5 to 7.

In FIGS. 5 and 6, it can be seen that the first guide formation 26 in the advanced position of the blade support 18 of FIG. 5 and in the intermediate position of FIG. 6 are out of contact with the second guide formation 28. After moving to the retracted position of the blade support 18 of FIG. 7, the primary counter surface 34 of the first guide formation 26 automatically engages the primary guide surface 30 of the second guide formation 28. The primary guide surface 30 forms an abutment against pivotal movement of the blade cover 24 in the direction $u_1$ and thus prevents the blade cover 24 from pivoting into the open position when the housing 11 of FIG. 8 is opened by releasing the cover 13 from the base 12. In other words, after the removal of the cover 13 from the base 12, the blade cover 24 remains in the closed position.

From FIG. 8, it can be seen that the primary counter surface 34 and the primary guide surface 30 are inclined to the x-axis of the movement directions $x_1$ and $x_2$ approximately at an angle of $\alpha$=45°. In a force that acts on the blade cover 24 in a movement in the direction $u_1$, i.e., in the direction of the open position, it is slightly moved with the entire blade support 18 in the direction $x_1$, so that the secondary counter surface 35 of the first guide formation 26 can come into contact with the secondary guide surface 31.

The secondary counter surface 35 and the secondary guide surface 31 are inclined to the x-axis of the moving directions $x_1$ and $x_2$ approximately at an angle of $\beta$=45°, such that a force on the blade cover 24 in the direction $u_2$, i.e., in the direction of the closed position, effects a displacement of the blade support 18 in the direction $x_1$. The angles $\alpha$ and $\beta$ can be the same size or different.

FIG. 8 shows that in the retracted position of the blade support 18, it is mounted on the base 12 such that it is movable only in the direction $x_1$, but not in one of the directions $y_1$ or $y_2$, and in one of the directions $z_1$ or $z_2$. In other words, the blade support 18 is stably held on the base 12 since it has only one degree of freedom of movement in the direction $x_1$, but is biased by the reset device 22 in the direction $x_2$.

The blade support 18 has two arms 44 provided with a hook 45 (see FIG. 9) that are part of the base 23 and extend from the blade seat 41 in the direction $x_2$. Only one of the arms 44 can be seen in the drawing. Each hook 45 is guided in a respective guide connecting link 46 on opposite edges 47 of the knife 10. The hook —45 includes a stop surface 48 that works together with a shoulder surface 49 to determine the advanced position of the blade support 18.

After the cover 13 has been removed from the base 12 of FIG. 8, a blade replacement may be performed as described below. The blade 19 is gripped by a blunt edge 38 (see FIG. 9) on opposite side surfaces 39 and 40 and loaded away from the base 23, as shown in FIG. 10, with the blade cover 24 is pivoted into the open position relative to the base 23 in direction $u_1$.

In this case, the first guide formation 26 and the second guide formation 28 move relative to each other such that the primary counter surface 34 and the primary guide surface 30 are disengaged. Then, according to FIG. 10, the ridge 36 of the first guide formation 26 comes into contact with the ridge 37 of the second guide formation 28 (see FIG. 10). Upon further pivoting of the blade cover 24 in the direction $u_1$, the secondary counter surface 35 and the secondary guide surface 31 move in contact, thereby holding the blade cover 24 in the open position as described above and shown in FIG. 11.

When the blade cover 24 is moved into the open position, as shown in FIGS. 11 and 12, the blade 19 can be removed very comfortably and an unused blade 19 can be fitted to a blade seat 41 of the base 23. Thereupon, by exerting a force on the actuating surface 25, the blade cover 24 can be pivoted in the direction $u_2$, and the blade support 18 is displaced somewhat in the direction $x_1$, so that the ridges 36 and 37 come into contact in an intermediate position of the blade cover 24. The closed position of FIG. 8 is reached with further pivoting of the blade cover 24 beyond the intermediate position of FIG. 14.

The blade 19 is then held again between the base 23 and the blade cover 24 in the closed position of the blade support 18. The primary guide surface 30 again contacts the primary counter surface 34 and secures the closed position. In addition, the blade support 18 is held firmly by the reset device 22 on the base 12.

After the cover 13 has been moved again in the direction $x_2$ on the housing seat 42 on the base 12 and the latch element 16 has moved into engagement with the recess 17, the knife is ready to use for a cutting operation again.

The invention claimed is:

1. A knife comprising:

a housing;

a blade support on the housing, having a blade seat for holding a blade, and movable on the housing between a retracted position bearing against the housing and with the blade inside the housing and a fully advanced position with the blade extending out of the housing;

a housing part movable on the housing between a closed position covering the blade support and an open position exposing the blade support, the blade support comprising a base and a blade cover, the blade cover being movable only in the open position of the housing part between a closed position and an open position relative to the base such that, in the closed position of the blade cover, the base and the blade cover securely hold the blade in the blade seat between the base and the blade cover and, in the open position of the blade cover, the base and the blade cover are so oriented relative to each other that the blade can be separated from the base and changed;

a reset device urging the blade support into the retracted position;

a first guide formation on the blade cover and having a counter surface;

a second guide formation on the housing and having a primary guide surface that works together with at least one face of the first guide formation in order to hold the blade support in the closed position and a secondary guide surface that works together with the counter surface of the first guide formation to hold the blade cover in the open position, the counter surface and secondary guide surface being engageable with each other in the retracted position of the blade support; and a ridge at which the primary and secondary guide surfaces meet.

2. The knife according to claim 1, wherein the blade cover is pivotable between the respective closed and open positions relative to the base.

3. The knife according to claim 1, wherein the second guide formation is on the base.

4. The knife according to claim 1, wherein the secondary guide surface and counter surface extend obliquely to an actuating direction and form a motion converter.

5. The knife according to claim 1, wherein the housing comprises a housing base and a housing cover.

6. The knife according to claim 5, wherein the housing cover forms a front housing part and the housing base forms a rear housing part.

7. The knife according to claim 6, wherein at least one of the housing parts is detachable such that the housing can be opened and a blade can be changed.

8. The knife according to claim 1, wherein the fully advanced position is a cutting position in which the blade projects from an opening of the housing.

9. A knife comprising:

a housing;

a blade support on the housing, having a blade seat for holding a blade, and movable on the housing between a retracted position bearing against the housing and with the blade inside the housing and a fully advanced position with the blade extending out of the housing;

a housing part movable on the housing between a closed position covering the blade support and an open position exposing the blade support, the blade support comprising a base and a blade cover, the blade cover being movable only in the open position of the housing part between a closed position and an open position relative to the base such that, in the closed position of the blade cover, the base and the blade cover securely hold the blade in the blade seat between the base and the blade cover and, in the open position of the blade cover, the base and the blade cover are so oriented relative to each other that the blade can be separated from the base and changed;

a reset device urging the blade support into the retracted position;

a first guide formation on the blade cover and having a counter surface;

a second guide formation on the housing and having a primary guide surface that works together with at least one face of the first guide formation in order to hold the blade support in the closed position and a secondary guide surface that works together with the counter surface of the first guide formation to hold the blade cover in the open position, the counter surface and secondary guide surface being engageable with each other in the retracted position of the blade support; and a guide track formed by the primary guide surface and the secondary guide surface, the first guide formation being movable on the guide track between engagement with the primary guide surface and the secondary guide surface.

10. The knife according to claim 9, wherein the blade support has to be out of the retracted position for the first guide formation to be able to move between engagement with the primary guide surface and engagement with the secondary guide surface.

11. A knife comprising:

a housing;

a blade support on the housing and having a blade seat for holding a blade, the blade support being movable between a retracted position in which the blade support is moved against a stop of the housing and in which the blade is retracted into the housing and a fully advanced position in which the blade is exposed;

a housing part movable on the housing between an open position exposing the blade support and a closed position covering the blade support, the blade support comprising a base and a blade cover movable only in the open position of the housing part between a closed position and an open position relative to the base such that, in the closed position of the blade cover, the base and the blade cover securely hold the blade in the blade seat between the base and the blade cover and, in the open position of the blade cover, the base and the blade cover are so oriented relative to each other that the blade can be changed;

a reset device urging the blade support toward the stop;

a first guide formation on the blade cover;

a second guide formation on the housing and having a primary guide surface that works together with a primary counter surface of the first guide formation in order to hold the blade support in the closed position and a secondary guide surface that works together with a secondary counter surface of the first guide formation in order to hold the blade cover in the open position; and a ridge at which the primary and secondary guide surfaces meet.

* * * * *